US007025662B2

(12) United States Patent
Nguyen Hoang et al.

(10) Patent No.: US 7,025,662 B2
(45) Date of Patent: Apr. 11, 2006

(54) ARRANGEMENT OF A CHEMICAL-MECHANICAL POLISHING TOOL AND METHOD OF CHEMICAL-MECHANICAL POLISHING USING SUCH A CHEMICAL-MECHANICAL POLISHING TOOL

(75) Inventors: Viet Nguyen Hoang, Delft (NL); Albert Jan Hof, Eindhoven (NL); Herma Van Kranenburg, Eindhoven (NL); Pierre Hermanus Woerlee, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 11/197,755

(22) Filed: Aug. 3, 2005

(65) Prior Publication Data

US 2006/0014479 A1 Jan. 19, 2006

Related U.S. Application Data

(63) Continuation of application No. 10/023,142, filed on Dec. 18, 2001.

(30) Foreign Application Priority Data

Dec. 22, 2000 (EP) ..... 00204787

(51) Int. Cl.
*B24B 53/00* (2006.01)
*B24B 7/22* (2006.01)

(52) U.S. Cl. ..... 451/41; 451/56
(58) Field of Classification Search ..... 451/41, 451/288, 287, 60, 443, 446, 5, 37
See application file for complete search history.

(56) References Cited

U.S. PATENT DOCUMENTS 5,478,435 A * 12/1995 Murphy et al. ..... 438/693
5,578,529 A * 11/1996 Mullins ..... 438/692

(Continued)

*Primary Examiner*—Robert A. Rose
(74) *Attorney, Agent, or Firm*—Peter Zawilski

(57) ABSTRACT

The invention relates to an arrangement of a chemical-mechanical polishing tool for chemical-mechanical polishing a surface on a wafer, comprising a polishing pad (4), a drive unit (9), pressing means (6), a wafer holder (5), first dispensing means (7) and second dispensing means (8); the wafer holder for holding a wafer (W) being arranged at a holder location (L0); the pressing means (6) being arranged to press the wafer holder (5) to the polishing pad (4); the first dispensing means (7) for dispensing a first fluid on the polishing pad (4) being arranged at a first dispensing means location (L1); the second dispensing means (8) for dispensing a second fluid on the polishing pad (4) being arranged at a second dispensing means location (L2); the polishing pad (4) comprising a polishing surface for polishing the wafer (W), and the polishing pad (4) further being connected to the drive unit (9) for moving the polishing surface in a first direction ($\omega_1$) relative to the holder location (L0);
wherein the first dispensing means location (L1) of the first dispensing means (7) is arranged in a downstream direction with respect to the holder location (L0) at a first downstream distance (d1), with the downstream direction being taken in relation to the first direction ($\omega_1$); and the second dispensing means location (L2) of the second dispensing means (8) is arranged in an upstream direction with respect to the holder location (L0) at a first upstream distance (d3), with the upstream direction being taken in relation to the first direction ($\omega_1$).

The invention further relates to a method of chemical-mechanical polishing using such an arrangement.

20 Claims, 4 Drawing Sheets

U.S. PATENT DOCUMENTS 5,651,725 A * 7/1997 Kikuta et al. ..... 451/41
5,981,394 A * 11/1999 Ohashi et al. ..... 438/692
6,120,347 A * 9/2000 Sandhu et al. ..... 451/5
6,227,947 B1 * 5/2001 Hu et al. ..... 451/56
6,398,627 B1 * 6/2002 Chiou et al. ..... 451/72
6,429,131 B1 * 8/2002 Lin et al. ..... 438/691

* cited by examiner

ARRANGEMENT OF A CHEMICAL-MECHANICAL POLISHING TOOL AND METHOD OF CHEMICAL-MECHANICAL POLISHING USING SUCH A CHEMICAL-MECHANICAL POLISHING TOOL

RELATED APPLICATIONS

This application is a continuation of application Ser. No. 10/023,142, filed 18 Dec. 2001, and entitled, "Arrangement of a Chemical-Mechanical Polishing Tool and Method of Chemical-Mechanical Polishing Using Such A Chemical-Mechanical Polishing Tool".

The present invention relates to an arrangement and a method as defined in the outset of claim 1.

In the semiconductor industry, the Damascene process is widely accepted as the mainstream technology for copper-based interconnects. In the Damascene process, as known to persons skilled in the art, first a blanket metal (copper) layer is deposited on top of a patterned dielectric layer with sufficient coverage to fill recessed areas in the dielectric layer, like trenches and vias. Subsequently, chemical-mechanical polishing (CMP) is used to remove the metal layer from the surface while the metal in the recessed areas is left behind to constitute (part of) the interconnect pattern.

Conventional CMP processes for metal layers use a slurry, containing basically three components: abrasive particles (e.g. $SiO_2$, $Al_2O_3$), an etching agent (e.g. an acid) and a passivating agent. The passivating agent passivates the metal's surface by growing a passivation layer. The abrasive component mechanically removes the passivation layer from the metal. The etching agent is used to etch the unpassivated metal. In the conventional process, the three components are dispensed on the polishing cloth as a mixture. Disadvantageously, slurries used in the conventional CMP process are known to have a relatively short period of stability (i.e. the chemical components decompose over time).

From U.S. Pat. No. 5,478,435, a dispensing apparatus to dispense a slurry in a CMP apparatus is known, which dispenses the separate components of the slurry through two (or in some cases, three or more) dispensing tubes to a polishing pad. By keeping the slurry components separated until used at the polishing pad, the dispensing apparatus of U.S. Pat. No. 5,478,435 reduces the problem of the slurry stability. The dispensing tubes transport the separate components to a point of use on the polishing pad, where the nozzles of the dispensing tubes are located closely together. Thus at the point of use, or proximate to it, the mixing of the components occurs to form the CMP slurry. In an alternative embodiment, the dispensing tubes are interconnected at their end as a single nozzle, located closely to the point of use. In this single nozzle the mixing of the components then takes place, just before reaching the point of use.

From U.S. Pat. No. 5,981,394 a dispensing apparatus is known which also utilizes two separate dispensing tubes to dispense the components of a slurry for mixing at, or close to, the point of use on the polish pad. Here, the second dispensing tube is arranged to supply additional chemical components to the slurry, dispensed by the first tube, for improvement of the CMP process to form a protective surfactant on the metal's surface.

Another disadvantage of CMP processes is the handling of the slurry particles in the system, which cause a poor cleanliness of processed wafers, and which, for example, may also cause damage to pumps and obstruction of waste pipes. Therefore, new slurry-free CMP processes have been developed, in which the abrasive particles in the slurry have been replaced by a fixed-abrasive pad in which the abrasive particles are embedded. Thus, a simple and clean CMP process can be expected, in which only a polishing liquid has to be added to the pad. For example, such a slurry-free CMP process for Cu interconnects is known from an article by M. Matsumoto et al., "Evaluation of Cu CMP for Interconnects Using a New Slurry-Free Process", proceedings of the 1999 Chemical-mechanical polishing for ULSI multilevel interconnection conference CMP-MIC 1999, February 1999, Santa Clara, pp. 176–183.

For the reason of physical and/or chemical stability, the compound ratio of such slurries and the temperature for conventional CMP processes must be within certain limits, which may compromise the performance of such CMP processes in some way. During a CMP process, simultaneously three competing processes (i.e. passivation, abrasion and etching) are taking place on a wafer's surface. Due to the imposed compound ratio, the relative influence of each of the processes is difficult to control. Therefore, a CMP process may not yield optimal results with regard to the dependence on e.g. pattern density, feature size, and uniformity.

Further, an important issue in CMP processing relates to the CMP metal removal rate which is found to depend on the pattern density of the Damascene structure. As known in the art, the large features in a pattern tend to become overpolished in comparison to the smaller features, and dishing effects tend to increase.

Moreover, another problem observed in CMP processing is the removal of abraded materials, which accumulate on the pad. Without removal of the abraded materials from the polishing pad, the abrasive action of the pad will be reduced, and the material removal rate of the CMP process will decrease substantially. As known to persons skilled in the art, polishing pads can be regenerated by ex-situ cleaning with a brush. However, this procedure reduces the life-time of the polishing pad substantially, due to high wear.

It is an object of the present invention to provide an arrangement of a CMP tool and a method to improve CMP processes using such a CMP tool.

The present invention relates to an arrangement of a chemical-mechanical polishing tool for chemical-mechanical polishing a surface on a wafer, comprising a polishing pad, a drive unit, pressing means, a wafer holder, first dispensing means and second dispensing means; the wafer holder for holding a wafer being arranged at a holder location; the pressing means being arranged to press the wafer holder to the polishing pad; the first dispensing means for dispensing a first fluid on the polishing pad being arranged at a first dispensing means location; the second dispensing means for dispensing a second fluid on the polishing pad being arranged at a second dispensing means location;

the polishing pad comprising a polishing surface for polishing the wafer, and the polishing pad further being connected to the drive unit for moving the polishing surface in a first direction relative to the holder location; characterized in that the first dispensing means location of the first dispensing means is arranged in a downstream direction with respect to the holder location at a first downstream distance, with the downstream direction being taken in relation to the first direction;

the second dispensing means location of the second dispensing means is arranged in an upstream direction with respect to the holder location at a first upstream distance, with the upstream direction being taken in relation to the first direction.

Also, the present invention relates to an arrangement of a chemical-mechanical polishing tool for chemical-mechanical polishing a surface on a wafer, as described above, characterized in that at the first dispensing means location the first dispensing means dispenses an etching agent on the polishing pad for dissolving abraded materials, originating from the surface on the wafer, from the polishing surface of the polishing pad, and at the second dispensing means location the second dispensing means dispenses a mixture of abrasive particles and a passivating agent on the polishing pad for passivating the surface on the wafer.

Moreover, the present invention relates to a method to be carried out in an arrangement of a chemical-mechanical polishing tool for chemical-mechanical polishing a surface on a wafer, comprising a polishing pad, a drive unit, pressing means, a wafer holder, first dispensing means and second dispensing means, the wafer holder for holding a wafer being arranged at a holder location; the pressing means being arranged to press the wafer holder to the polishing pad; the first dispensing means for dispensing a first fluid on the polishing pad being arranged at a first dispensing means location; the second dispensing means for dispensing a second fluid on the polishing pad being arranged at a second dispensing means location;

the polishing pad, comprising a polishing surface for polishing the wafer, and the polishing pad further being connected to the drive unit for moving the polishing surface in a first direction relative to the holder location;

Characterized by the Following Steps:

to arrange the first dispensing means location of the first dispensing means in a downstream direction with respect to the holder location at a first downstream distance, with the downstream direction being taken in relation to the first direction, and to arrange the second dispensing means location of the second dispensing means in an upstream direction with respect to the holder location at a first upstream distance, with the upstream direction being taken in relation to the first direction.

Also, the present invention relates to a method to be carried out in an arrangement of a chemical-mechanical polishing tool for chemical-mechanical polishing a surface on a wafer, as described above, characterized by the following steps:

to dispense at the first dispensing means location by the first dispensing means, an etching agent on the polishing pad for dissolving abraded materials originating from the metal surface on the wafer, from the polishing surface of the polishing pad, and to dispense at the second dispensing means location by the second dispensing means, a passivating agent on the polishing pad for passivating the metal surface on the wafer.

Thus, the material removal rate of the CMP process according to the present invention will be more constant than in the prior art. Also, the ratio of etching agent to passivating agent in the polishing liquid can be chosen within wider limits than in the prior art. This will provide a better control of the passivation and etching processes. As a consequence, the removal rate will become more constant: i.e. less dependent on feature size and pattern density, which reduces overpolishing and dishing effects.

Moreover, the removal rate uniformity across a wafer can thus be enhanced.

Also, the wafer-to-wafer reproducibility of the CMP process is improved by the arrangement and method of the present invention.

Furthermore, with the present invention the requirement for mechanical conditioning of polishing pads is strongly reduced. Therefore, the life-time of polishing pads will increase due to the present invention. Also, by means of the present invention, the down-time of a CMP tool, due to the replacement and the conditioning of the polishing pad, will reduce significantly.

Below, the invention will be explained with reference to some drawings, which are intended for illustration purposes only and not to limit the scope of protection as defined in the accompanying claims.

FIGS. 1*a* and 1*b* show schematically a cross-sectional view of the surface of a polishing pad, before and after contamination with abraded materials, respectively, according to the prior art;

Figure 4A:
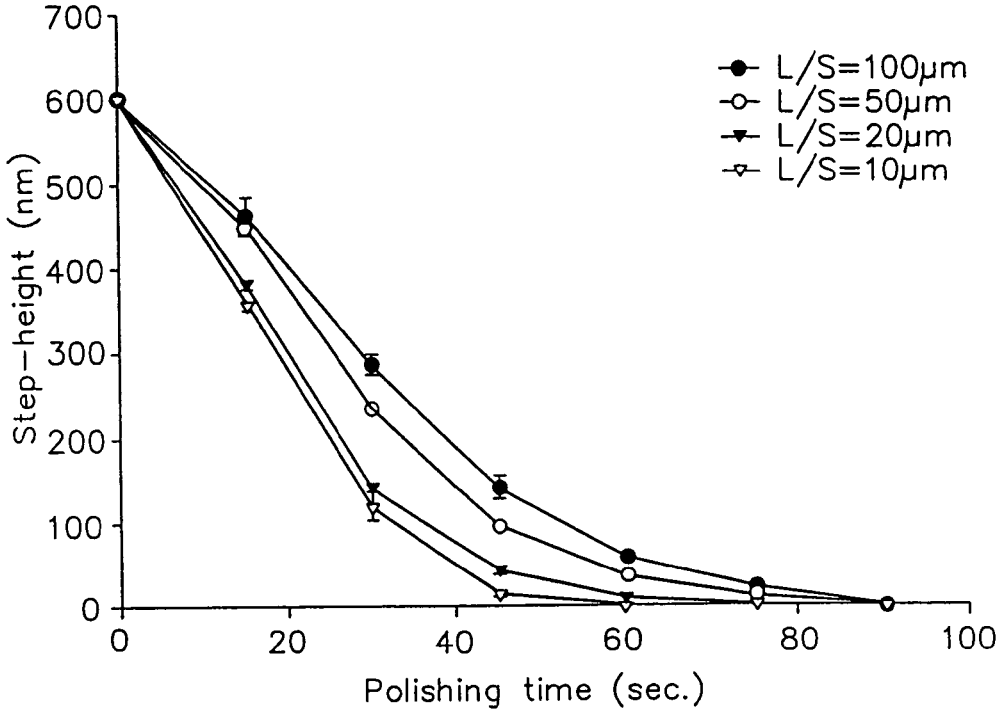
Figure 4B:
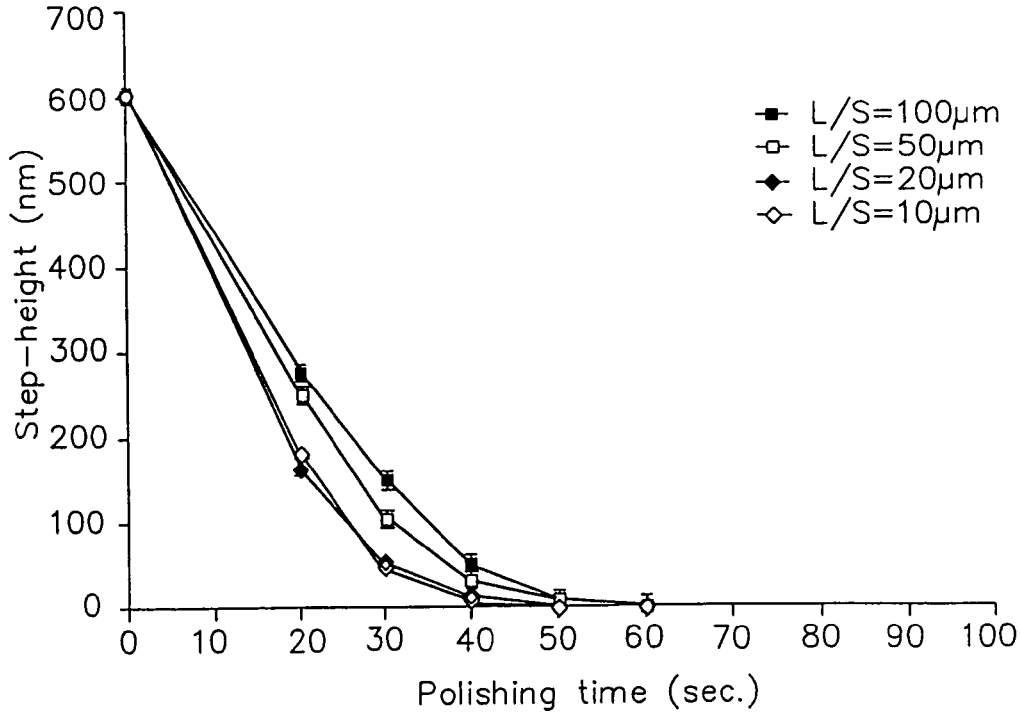

FIGS. 4*a* and 4*b* show diagrammatically exemplary results of an experiment, in which the step-height reduction was measured as a function of polishing time in a CMP process, with and without the application of the present invention, respectively.

Figure 1A:
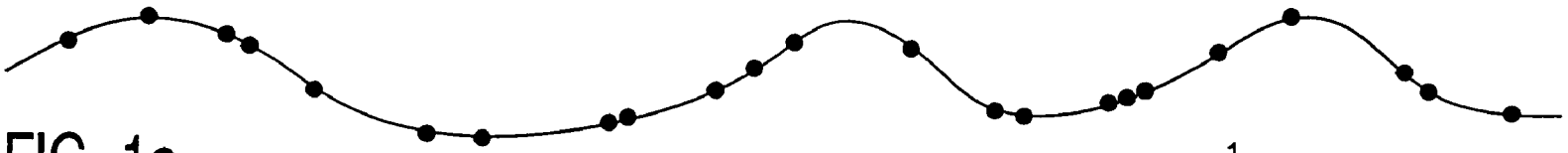
Figure 1B:
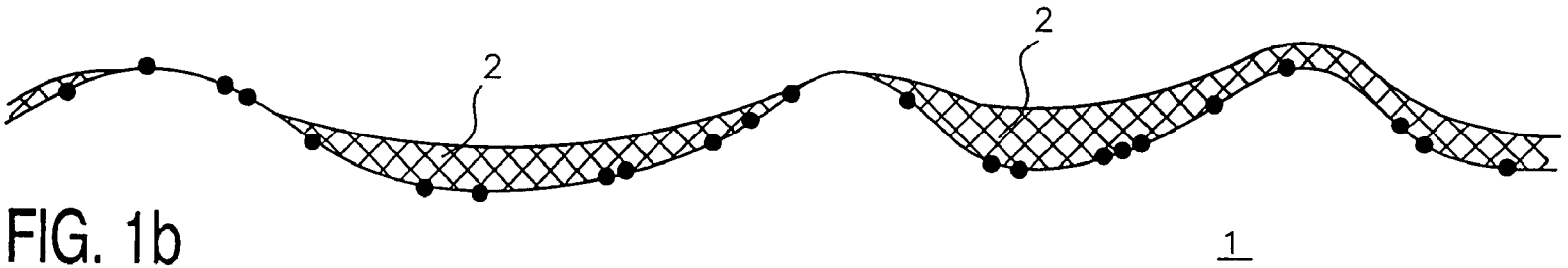

To improve CMP processes, the present invention provides an arrangement and a method as will be described below. In FIGS. 1*a* and 1*b*, a cross-sectional view of the surface of a polishing pad in accordance with the prior art is schematically shown. FIG. 1*a* depicts the surface of a clean polishing pad, while in FIG. 1*b* the surface of a polishing pad, contaminated with abraded materials, is shown.

In FIG. 1*a*, a cross-sectional view of a polishing pad's surface 1 comprising a plurality of abrasive particles (diameter: ~0.1 μm) embedded in the surface of the pad is schematically shown. The polishing pad consists of a polymer layer, with a slightly undulating surface with hillocks (width: ~10 μm). When passing under the wafer during CMP, the abrasive particles, depicted here as solid dots, become partially embedded and fixated in the polymer layer.

As known to persons versed in the art, the abrasive action of such a polishing pad is substantially performed by the abrasive particles located on, or near to, the tops of the hillocks, which are in contact with the wafer's surface, when in use.

During CMP processing of a metal layer on a semiconductor substrate, the passivated layer in contact with the protruding abrasive particles in the polishing pad is mechanically removed, and deposited on the surface of the pad. The abraded materials 2 accumulate on the surface of the pad as is schematically depicted in FIG. 1*b* by the grey areas at the pad's surface. Due to the accumulation of abraded materials on the pad (and more particularly, at the hillock tops), the abrasive action of the polishing pad diminishes.

The present invention provides an arrangement and a method to prevent the contamination of the pad's surface. As known in the art, mechanical removal of the abraded materials is not very effective and may produce free particles that contaminate a wafer surface.

Therefore, chemical removal by dissolution of the abraded materials is used. Typically, to this end an (acidic) etching agent must be used. However, as known from the prior art, a polishing liquid must not predominantly have the characteristics of such an etching agent, because in that case, the copper layer on the wafer will be etched isotropically without any planarization. As known to persons skilled in the art, severe etching of the metal structure on the wafer surface will then be the result.

Figure 2:
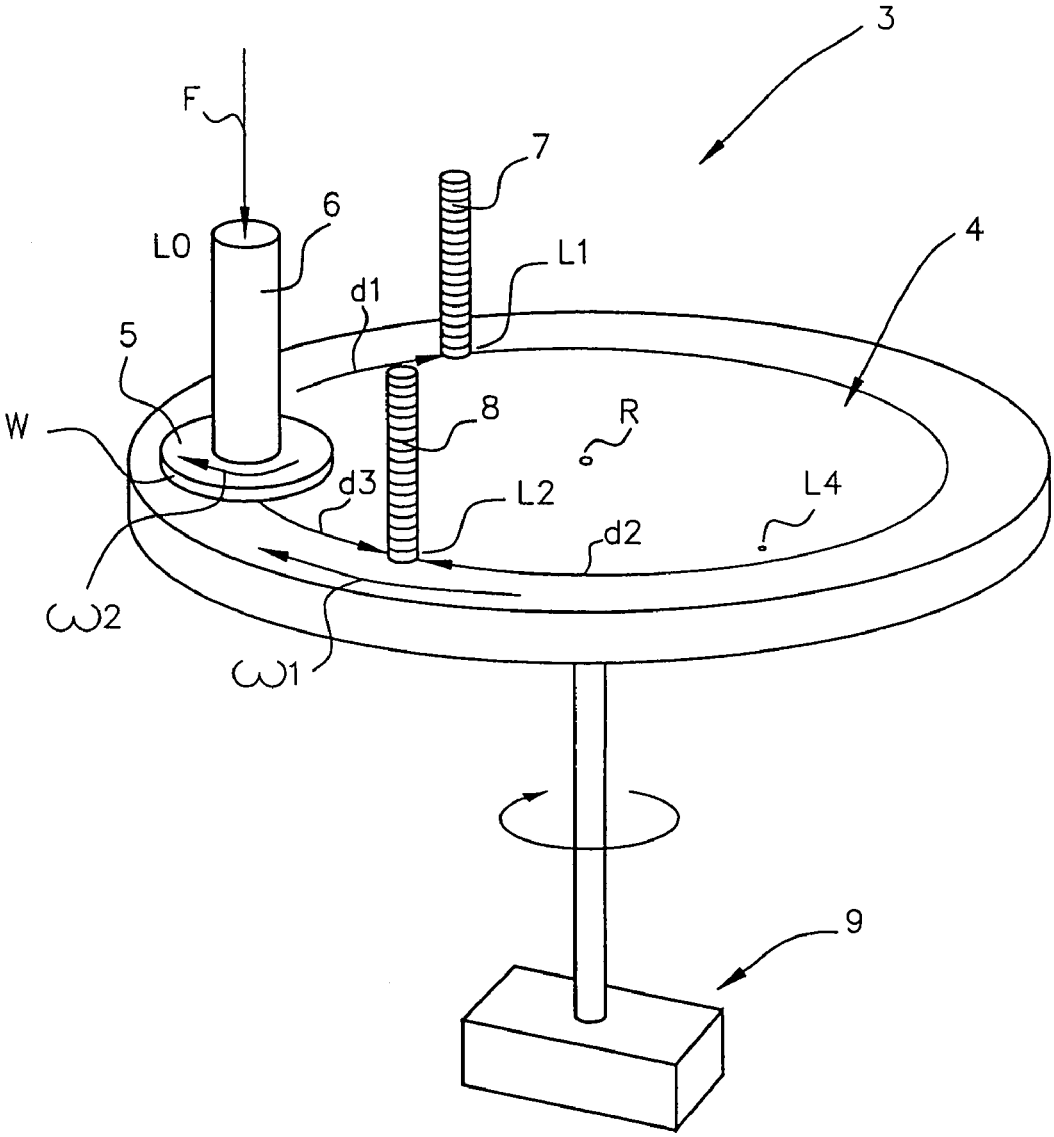
FIG. 2 shows schematically in a first preferred embodiment, an example of a dispensing apparatus, according to the present invention, arranged in a CMP tool.

In the present invention, the problems of the prior art as mentioned above are solved by an arrangement as shown in FIG. 2. FIG. 2 shows schematically in a first preferred embodiment, an example of a dispensing apparatus, according to the present invention, arranged in a CMP tool. The CMP tool 3 comprises a polishing pad 4, a wafer holder 5, pressing means 6, an etching agent dispensing tube 7, a passivating agent dispensing tube 8 and a drive unit 9.

The polishing pad 4 is a pad with a structure as shown in FIG. 1*a*. The polishing pad 4 is provided with the rotational drive unit 9 for rotation while polishing. The polishing pad 4 spins around a centre of rotation R. The rotational direction is indicated by the arrow $\omega_1$. At a holder location L0, located at a radial distance from the centre of rotation R, the wafer holder 5 is arranged to hold a wafer W during the polishing process. Connected to the wafer holder 5 is the pressing means 6. During the polishing process the pressing means 6 presses the wafer W in the wafer holder 5 with a predetermined force F to the surface of the polishing pad 4. The pressing means 6 is arranged with a rotational drive unit 9 to rotate the wafer holder 5 during polishing. The rotational direction is indicated by the arrow $\omega_2$ The dispensing apparatus of the CMP tool 3 comprises two dispensing tubes 7, 8 for dispensing the separate components of the polishing liquid to the polishing pad 4. The etching agent dispensing tube 7 dispenses the etching agent on the polishing pad 4 at a first tube location L1. The first tube location L1 is located near the holder location L0, displaced over a first downstream distance d1 in the downstream direction relative to the rotational direction indicated by arrow $\omega_1$. The etching agent contains a chemical compound, capable of dissolving the abraded materials, accumulated on the pad's surface, as described with reference to FIG. 1*b*. The passivating agent dispensing tube 8 dispenses a mixture consisting of a passivating agent and abrasive particles on the polishing pad 4 at a second tube location L2. The second tube location L2 is located near the holder location L0, displaced in the upstream direction over a first upstream distance d3 relative to the rotational direction indicated by arrow $\omega_1$. The first upstream distance d3 is equivalent to a second downstream distance d2 measured in the downstream direction, since the movement of a location on the polishing pad describes a closed loop. In the present invention, the first upstream distance d3 to locate the second tube location L2 is chosen in such a way that the second downstream distance d2 is larger than the first downstream distance d1. By positioning the dispensing tubes 7, 8 in this manner, the trajectory between the first dispensing tube 7 and the second dispensing tube 8 (measured in the rotational direction from the first tube location L1 to the second tube location L2) is much larger than the trajectory between the second dispensing tube 8 and the first dispensing tube 7 (measured in the rotational direction from the second tube location L2 to the first tube location L1). In this arrangement, advantageously two ranges are created on the polishing pad, each with a different function in the CMP process, as will be explained below in more detail.

The passivating agent (or passivator) is an agent capable of passivating the metal's surface on the wafer by the formation of a passivation layer that protects the metal's surface from the etching agent. The passivating agent may contain an oxidizing agent (e.g. $H_2O_2$), that forms a metal oxide layer on the metal's surface as a passivation layer. Also, the passivating agent may be a reagent that forms a layer of an insoluble metal salt on the metal's surface (e.g., phtalic acid in case of copper-based metallizations). Also, other passivating agents are conceivable that form monolayer coatings on the surface, or passivating agents with surfactant properties.

In the arrangement, as illustrated by FIG. 2, the surface of the polishing pad 4, is exposed to various conditions during a full revolution of the pad. For example, during one revolution of the pad, a particular location L4 at the pad's surface first passes under the passivating agent dispensing tube 8 at the second tube location L2. Here, the surface receives a quantity of passivating agent, mixed with abrasive particles.

Next, the location L4 passes under the wafer W attached to the wafer holder 5 at holder location L0. At this point, the abrasive particles embedded in the surface of the polishing pad, remove the passivation layer from the metal surface of the wafer W. The passivating agent dispersed on the pad's surface at location L4 is now in close contact with the metal and passivates the metal's surface again. The abraded materials are deposited on the pad's surface and accumulate on the pad (FIG. 1*b*). At the contact area of the wafer and the polishing pad, the processes of passivation and removal take place simultaneously and continuously. It is noted, that due to the presence of etching agent on the pad, after removal of the passivation layer, some etching of the metal layer may occur.

Also, in the present invention, a small quantity of etching agent can be added to the mixture (of passivator and abrasive particles) dispensed at the passivating agent dispensing tube. In this manner, a further control of the characteristics of the CMP process is provided.

Due to the rotation of the polishing pad 4, the abraded materials are transported out of the contact area between the wafer and the polishing pad at the holder location L0.

Subsequently, the location L4 passes under the etching agent dispensing tube 7 at the first tube location L1. The surface receives a quantity of etching agent at this point. The etching agent is capable of dissolving the abraded materials by a chemical reaction. Due to the centrifugal force the solution containing the dissolved abraded materials flows from the pad at the pad's circumference. Therefore, after the dissolution step, the pad's surface is clean and substantially free of abraded materials.

Due to the separated supply of the etching agent and the passivating agent through the etching agent dispensing tube 7 at the first tube location L1 and the passivating agent dispensing tube 8 at the second tube location L2, respectively, the concentration of the etching agent and the passivating agent vary as a function of the relative location on the polishing pad in relation to the holder location L0. On the trajectory of the location L4 on the pad, between the first and second tube locations L1 and L2 of the dispensing tubes 7 and 8, respectively, the concentration of the etching agent on the pad's surface is relatively high in comparison to the concentration of the passivating agent, and the polishing liquid predominantly has the characteristics of an etchant. However, on the trajectory of the location L4 on the pad, between the second and first tube locations L2 and L1, the situation is reversed: the concentration of the etching agent on the pad's surface is relatively low in comparison to the concentration of the passivating agent, and the polishing liquid predominantly has the characteristics of a passivator. Consequently, the wafer W attached to the wafer holder 5, at the fixed holder position L0 in between the first and second tube locations L1 and L2, is exposed to the polishing liquid with predominantly the characteristics of a passivator. Since the etching agent is still available (in a controllable and relatively low concentration) between the locations L1 and L2, the etching step of the CMP process may be carried out as well at the surface of wafer W. The etch rate however, is low, due to the higher concentration of the passivating agent and the corresponding degree of passivation of the surface of the wafer W. It is noted that although the etch rate is low, the removal rate of the CMP process is not affected here. In a CMP process according to the present invention for copper metallization, the removal rate is between 300 and 500 nm/min.

Furthermore, it is noted here that the dispensing of the etching agent and the passivating agent is continuous during the CMP process. Thus, during the CMP process, the concentration distribution of etchant and passivator on the pad can be regarded as a steady-state condition. The rotating polishing pad 4 comprises a first steady-state zone in the trajectory between locations L1 and L2, in which the area of the pad within that first zone is mainly subjected to the etching and cleaning step. In a second steady-state zone in the trajectory between locations L2 and L1, the area of the pad within that second zone mainly contains the passivator, which reacts with the metal's surface on the wafer W.

Also, it is noted that the dispensing of the etching agent and the passivating agent by dispensing tubes 7, 8, may be done in an alternative manner: the tubes 7, 8 may each be arranged in any other suitable shape, e.g. as a shower head assembly with an array of closely spaced openings.

In the embodiment as shown in FIG. 2, essential parameters like the flow, the concentration, and the temperature of the etching agent and the passivating agent, respectively, can each be controlled independently, which in the present invention allows a process window which may be wider than for the conventional CMP process.

FIGS. 3A–3D illustrate schematically in a block diagram the successive stages of the slurry-free CMP process according to the present invention. In the left-hand column, the successive stages of a wafer W are schematically depicted in a cross-sectional view. In the right-hand column, the successive stages of a part of the polishing pad's surface at location L4 are shown schematically in a cross-sectional view.

Figure 3A:
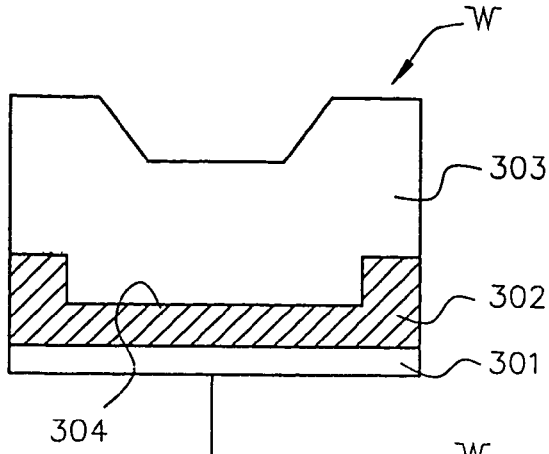
FIGS. 3A–3D illustrate schematically the successive stages of the CMP process as carried out by using the arrangement and the method of the present invention.

FIG. 3A shows the wafer W prior to the CMP process. Prior to the CMP process, the wafer W comprises a substrate layer 301, an insulating layer 302, and a metal layer 303. In the insulating layer 302 a patterned area 304 is present, which is filled by the metal layer 303. In the surface of the metal layer, a recessed area 305 is shown contouring the patterned area 304.

Figure 3B:
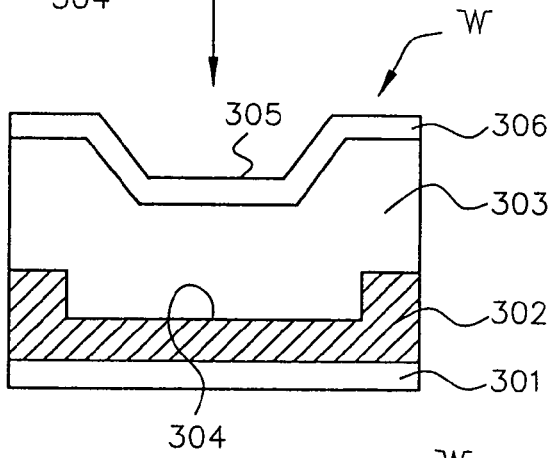
Figure 3C:
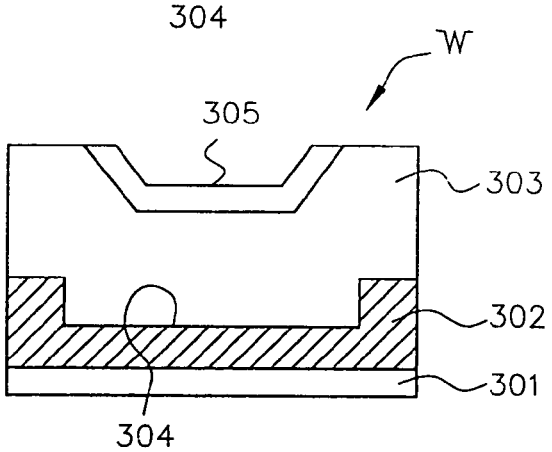
Figure 3D:
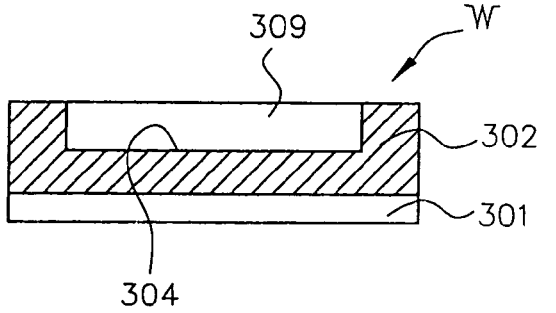

FIGS. 3B–3D show the CMP process carried out. In FIG. 3B the wafer W is shown with a passivated (metal oxide or metal salt) layer 306 grown by the reaction of the metal with the passivating agent. During polishing, the passivated layer at the top level 307, is removed, while the passivated layer in the recessed area 305 remains on the surface.

This situation is shown in FIG. 3C: on the wafer W a protruding area of the free metal surface 308 is present, where the passivated layer is removed.

During the CMP process, the polishing pad 4 appears at the location L2 in a fresh and clean state with abrasive particles embedded in the surface, identical to the situation sketched in FIG. 1*a*. After passing the wafer at holder location L0, the location L4 of the pad arrives at location L1. Due to the accumulation of abraded materials on the polishing pad's surface, the abrasive function of the polishing pad is reduced. At this point L1, the location L4 on the polishing pad 4 is in a state as illustrated in FIG. 1*b*.

At location L1, the etching agent is added to the pad's surface. The polishing fluid at this point has a relatively high concentration of etching agent. During the transfer from location L1 to location L2, the abraded materials are dissolved by the etching agent. Due to the centrifugal force, the solution containing the dissolved abraded materials flows from the pad at the pad's circumference during the transfer from location L1 to L2. The polishing pad 4 now appears fresh before the holder location L0 with the wafer W is reached (again as shown in FIG. 1*a*).

At location L2 a mixture of passivating agent and abrasive particles is dispensed on the pad.

During the CMP process the metal layer is removed until the situation shown in FIG. 3D is reached. In FIG. 3D, the remaining metal layer is only present in the patterned area as an interconnect 309. Further, at this stage the polishing pad 4 is still clean due to the exposure of the pad to the etching agent between locations L1 and L2 (as shown by the cross-sectional view of FIG. 1*a*).

Due to the constant cleaning of the polishing pad 4 during the CMP process, the material removal rate remains at a constant and high level.

To characterize the CMP process, experiments were carried out using a state-of-the-art polishing tool. As an etching agent a home-made acidic buffer (pH=3) was used. As an passivating agent $H_2O_2$ (as oxidizer, 35% in $H_2O$) was used. It is noted that the concentration of the etching agent and the passivating agent are given here as examples. Other agents and/or concentrations may yield similar satisfactory results.

Wafers, both blanket and patterned (in $SiO_2$), covered by a copper layer with an as-deposited thickness of 1.2 μm were polished by the CMP process according to the present invention. The test Damascene structures on the patterned wafers had various line widths and various pattern densities. As test patterns, line/space patterns, with line widths from 0.2 to 100 μm were used. The pattern density varied from ~25% to ~80%. In all test structures, the depth of trenches was 600 nm.

FIGS. 4*a* and 4*b* show diagrammatically exemplary results of the experiments described above, in which the planarisation rate was measured in a slurry-free CMP process, carried out according to the conventional process as known from the prior art, and carried out according to the present invention, respectively. In the graph of FIG. 4*a*, the step-height reduction of trenches with various line widths is plotted as a function of the polishing time in a CMP process in accordance with the prior art. For clarity, only the results for a pattern density of 50% are shown. Results on lines with a line width of 100, 50, 20 and 10 μm are marked by solid circles, open circles, solid triangles and open triangles, respectively. (For other pattern densities varying from ~25% to ~80%, similar results were obtained.)

In the graph of FIG. 4*b*, the step-height reduction of trenches with various line widths is plotted as a function of the polishing time in a CMP process according to the present invention. Results on lines with a line width of 100, 50, 20 and 10 μm are marked here by solid squares, open squares, solid diamonds and open diamonds, respectively. Again, the pattern density was 50%.

From FIGS. 4*a* and 4*b* it is clear that the CMP process according to the present invention has a higher planarization rate than the conventional CMP process. (Depending on the polishing conditions, the removal rate was in the range from 300 to 500 nm/min for the CMP process according to the present invention.) Also, the step-height reduction for the CMP process according to the present invention is almost identical for the various line widths of the pattern. Thus, the planarization rate for the CMP process according to the present invention appears to be (almost) independent of the actual pattern line widths. This indicates clearly that the CMP process according to the present invention reduces the dishing of wider trenches during overpolishing. Due to the higher concentration of passivating agent on the polishing pad, close to the location of the wafer W, a well-defined passivation layer is constantly formed at the wafer's surface during the full time span of the CMP process. As illustrated by FIGS. 3A1–3C2, the formation of a passivation layer efficiently protects the lower recessed areas 305 of the wafer's surface resulting in only the removal of material at the protruding areas 307, 308 of the surface. Therefore, a high and constant planarisation rate is achieved, with very low dependence on the pattern density and pattern feature size.

In summary, the passivation during CMP is improved, due to the improved control of the dispensing of the passivating agent (and the agent's concentration). The planarization of the Damascene structure is improved, because of the improved passivation of the recessed areas in the wafer's pattern. Moreover, the dependence of the planarization on the pattern density is reduced by the better passivation of recessed areas with different feature size.

It will be appreciated that the present invention is not limited to CMP tools 3 with a rotating polishing pad 4 and pressing means 6 at a fixed position L0. The present invention may be applied in other types of CMP tools as known in the art: e.g. with belt-shape polishing pads or with pressing means moving in relation to the (fixed) polishing pad. Also, the present invention may be applied in CMP tools with a fixed abrasive pad, in which case no abrasive particles need to be dispensed at the passivating agent dispensing tube.

In the present invention, a novel configuration for CMP processing of metals is disclosed. The dispensing tubes are arranged in such a way that the two main components (etchant and passivator) of the polishing fluid are supplied separately on different areas of the polishing pad's surface. The present invention thus reduces the difficulties of composing a polishing slurry and offers better opportunities for process optimization. The trade-off between the etching and the passivation of the surface is improved by separating the etchant and passivator flows to the polishing pad. The separation of the components results in composition gradients which lead to a different passivation rate of the metal and different dissolution rates of metal oxides (or metal salts) at different areas of the polishing pad's surface. Consequently, the CMP process according to the present invention obtains excellent removal and planarization rates.

Also, it will be appreciated that in the dispensing of the passivating agent at the passivating agent dispensing tube 8, a small quantity of etching agent may be added controllably to the passivation agent in order to have some slight etching action taking place simultaneously with the polishing and the passivation actions, while processing a wafer W at the location L0 of the wafer holder.

Moreover, it will be appreciated that the CMP process according to the present invention is not to be used exclusively for copper-based metallization, but also for other metallizations. For example, CMP processing according to the present invention shows good results relating to the patterning of tungsten layers.

Also, the lifetime of the polishing pad increases since the requirements for mechanical conditioning of the pad are strongly reduced by the in-situ cleaning action of the etching agent.

It will be evident to those skilled in the art that the arrangement and method of the invention can be advantageously applied in the manufacture of semiconductor devices.

The invention claimed is:

1. A chemical-mechanical polishing tool for chemical-mechanical polishing a surface on a wafer, comprising:

a polishing pad, a drive unit, a pressing means, a wafer holder, a first dispensing means and second dispensing means; the wafer holder disposed at a holder location (L0); the pressing means adapted to press the wafer holder to the polishing pad; the first dispensing means adapted to dispense a first fluid on the polishing pad and disposed at a first dispensing means location (L1); the second dispensing means adapted to dispense a second fluid on the polishing pad and disposed at a second dispensing means location (L2);

the polishing pad comprising a polishing surface for polishing the wafer, and the polishing pad further connected to the drive unit for moving the polishing surface in a first direction ($\omega_1$) relative to the holder location (L0);

wherein the first dispensing means location (L1) is in a downstream direction with respect to the holder location (L0) at a first downstream distance (d1), with the downstream direction being taken in relation to the first direction ($\omega_1$), and the second dispensing means location (L2) is in an upstream direction with respect to the holder location (L0) at a first upstream distance (d3), with the upstream direction being taken in relation to the first direction ($\omega_1$); and wherein a radial distance between the first dispensing means location (L1) and the second dispensing means location (L2) in a downstream direction is greater than a radial distance between the first dispensing means location (L1) and the second dispensing means location (L2) in the upstream direction.

2. The chemical-mechanical polishing tool of claim 1, wherein the first dispensing means dispenses an etching agent on the polishing pad for dissolving abraded materials from the polishing surface of the polishing pad, and the second dispensing means dispenses a mixture of abrasive particles and a passivating agent on the polishing pad.

3. The chemical-mechanical polishing tool of claim 1, wherein the first and second dispensing means each comprise a dispensing tube with a plurality of closely spaced dispensing openings.

4. The chemical-mechanical polishing tool of claim 2, wherein the surface on the wafer is a surface of a metal layer.

5. The chemical-mechanical polishing tool of claim 4, wherein the passivating agent is an oxidizing agent for the metal layer.

6. The chemical-mechanical polishing tool of claim 4, wherein the passivating agent is a reagent that forms a layer of an insoluble metal salt of the metal layer.

7. The chemical-mechanical polishing tool of claim 4, wherein the passivating agent is a reagent that forms a thin film coating on the metal layer, the thin film being a monolayer.

8. The chemical-mechanical polishing tool of claim 4, wherein the passivating agent is a surfactant.

9. The chemical-mechanical polishing tool of claim 5, wherein the oxidizing agent is $H_2O_2$.

10. The chemical-mechanical polishing tool of claim 4, wherein the passivating agent is phtalic acid.

11. The chemical-mechanical polishing tool of claim 4, wherein the etching agent is a dissolving agent for abraded metal/metal-oxide/metal salt materials.

12. The chemical-mechanical polishing tool of claim 4, wherein the etching agent is an acidic buffer for dissolving abraded metal/metal-oxide/metal salt materials.

13. The chemical-mechanical polishing tool of claim 1, further comprising rotational means for rotating the wafer holder wherein the wafer holder, which is connected to the rotational means, is arranged so as to rotate in a second rotational direction ($\omega_2$).

14. The chemical-mechanical polishing tool of claim 1, wherein the wafer polishing surface of the polishing pad is arranged as a fixed abrasive pad, and the second dispensing means dispenses the passivating agent.

15. The chemical-mechanical polishing tool of claim 2, wherein the second dispensing means further dispenses a small quantity of the etching agent.

16. A method to be carried out in an arrangement of a chemical-mechanical polishing tool that comprises a polishing pad, a drive unit, a pressing means, a wafer holder, a first dispensing means and a second dispensing means; the wafer holder for holding a wafer, disposed at a holder location (L0); the pressing means adapted to press the wafer holder to the polishing pad; the first dispensing means adapted to dispense a first fluid on the polishing pad, and disposed at a first dispensing means location (L1); the second dispensing means adapted to dispense a second fluid on the polishing pad, and disposed at a second dispensing means location (L2); the polishing pad comprising a polishing surface for polishing the wafer, and the polishing pad connected to the drive unit for moving the polishing surface in a first direction ($\omega_1$) relative to the holder location (L0); the method comprising:

positioning the first dispensing means location (L1) in a downstream direction with respect to the holder location (L0) at a first downstream distance (d1), with the downstream direction being taken in relation to the first direction ($\omega_1$), and positioning the second dispensing means location (L2) in an upstream direction with respect to the holder location (L0) at a first upstream distance (d3), with the upstream direction being taken in relation to the first direction ($\omega_1$); and wherein a radial distance between the first dispensing means location (L1) and the second dispensing means location (L2) in a downstream direction is greater than a radial distance between the first dispensing means location (L1) and the second dispensing means location (L2) in the upstream direction.

17. The method of claim 16, further comprising:

dispensing by the first dispensing means, an etching agent on the polishing pad for dissolving abraded materials, originating from the metal surface on the wafer, from the polishing surface of the polishing pad, and dispensing by the second dispensing means, a passivating agent on the polishing pad for passivating the metal surface on the wafer.

18. The method of claim 17, wherein the passivating agent is an oxidizing agent for a metal layer that is disposed on the surface of the wafer.

19. The method of claim 17, wherein the passivating agent is a reagent that forms a layer of an insoluble metal salt on the metal layer.

20. A method of chemical-mechanical polishing, comprising:

providing a circular polishing pad adapted to rotate in a first direction;

providing a wafer holder with a wafer contained therein, the wafer positioned within the wafer holder such that a surface to be polished is brought into contact with the polishing pad at a polishing location;

dispensing a first liquid at a first dispensing location, the first dispensing location being a first distance from the polishing location in a downstream direction from the polishing location; and dispensing a second liquid at a second dispensing location, the second dispensing location being a second distance from the polishing location in an upstream direction from the polishing location;

wherein the downstream direction is the direction in which the polishing pad rotates, and the upstream direction is the direction opposite to which the polishing pad rotates;

wherein a radial distance between the first dispensing location and the second dispensing location in the downstream direction is greater than a radial distance between the first dispensing location and the second dispensing location in an upstream direction; and wherein the first liquid dissolves abraded material disposed on the polishing pad.

* * * * *